United States Patent [19]

Chiappetti

[11] 4,437,654

[45] Mar. 20, 1984

[54] VISE WITH INTERCHANGEABLE JAW MEMBERS

[76] Inventor: Pietro Chiappetti, 5341 Hawley Ave., Los Angeles, Calif. 90042

[21] Appl. No.: 505,896

[22] Filed: Jun. 21, 1983

Related U.S. Application Data

[63] Continuation of Ser. No. 357,061, Mar. 11, 1982, abandoned.

[51] Int. Cl.[3] ..... B25B 1/24

[52] U.S. Cl. ..... 269/283

[58] Field of Search ..... 269/283, 282, 280, 279, 269/271, 261, 262; 81/180 R–180 D

[56] References Cited

U.S. PATENT DOCUMENTS

| | | | |
|---|---|---|---|
| 164,291 | 6/1875 | Gleason et al. | 269/283 |
| 307,453 | 11/1884 | Galbraith | 269/283 |
| 1,596,169 | 8/1926 | Follmer | 269/283 |
| 2,820,495 | 1/1958 | Wetzler | 269/271 |
| 3,341,190 | 9/1967 | Adamson | 269/271 |
| 3,499,206 | 3/1970 | Quernheim | 269/283 |

FOREIGN PATENT DOCUMENTS

| | | | |
|---|---|---|---|
| 1237780 | 6/1960 | France | 269/282 |

*Primary Examiner*—Robert C. Watson

*Attorney, Agent, or Firm*—Fulwider, Patton, Rieber, Lee & Utecht

[57] ABSTRACT

A vise having readily interchangeablee jaw members for holding a variety of types of workpieces, wherein a jaw member having a working surface adapted for holding a workpiece is slideably engaged to each jaw of the vise, enabling a workman to easily install a selected jaw member having the proper working surface for holding a particular workpiece. A support block on each jaw of the vise has a pair of vertically extending ribs and a horizontally extending ledge of the bottom of the support block. The jaw member includes a pair of L-shaped locking arms adapted for slidable engagement over the ribs of the support block, so that a jaw member may be installed by engaging the locking arms of the jaw member with the ribs of the support block and sliding the jaw member downwardly to stop against the horizontal ledge of the support block.

6 Claims, 5 Drawing Figures

VISE WITH INTERCHANGEABLE JAW MEMBERS

This application is a continuation of application Ser. No. 357,061, filed Mar. 11, 1982 now abandoned.

BACKGROUND OF THE INVENTION

This invention relates generally to vises for holding workpieces, and more particularly, to a vise having readily interchangeable jaw members for holding various types of workpieces.

Vises are used in businesses and homes by workmen to hold workpieces while some operation is performed on the workpiece. A typical bench vice, for example, includes a base for attachment to a workbench, a housing attached to the base and having a fixed jaw, a moveable jaw, and a mechanism linking the movable jaw to the support housing so that the movable jaw may be moved toward the fixed jaw to contact and hold a workpiece between the two jaws.

Each jaw typically has a working surface which contacts the workpiece and transmits the compressive holding loads to the workpiece. The working surface in most vises is smooth or scored steel, but it is sometimes found that for holding specific workpieces the working surface is more appropriately of a different configuration, finish or material. It is therefore desirable that provision be made for utilizing any of a variety of working surfaces for holding specific workpieces between the jaws of the vise.

In one approach to allowing the use of a variety of working surfaces, the standard flat-faced jaws are used, and an intermediate piece of special tooling is placed between the jaw and the workpiece. This method is often unsatisfactory, however, since the workman must attempt to simultaneously position the workpiece and the tooling, and also tighten the vise jaws. In another approach, several designs for interchangeable jaw members having particular working surfaces have been proposed, but in such designs each removable jaw member is fastened to the jaw with a bolt, screw or other semi-permanent fastener, so that changing the jaw member is a time-consuming process which may interfere with the smooth flow of operations on the workpiece. To use such jaw members the workman must remove the fasteners to loosen and remove one set of jaw members and then install and fasten into position the second set of jaw members. This is a cumbersome process whose shortcomings may deter the workman from utilizing a jaw member having the proper working surface.

Accordingly, there has been a need for a vise wherein the working surface for contacting the workpiece may be readily interchanged with another working surface more appropriate to a specific job to be done. The present invention fulfills this need, and further provides related advantages.

SUMMARY OF THE INVENTION

The present invention provides a vise construction for holding workpieces between working surfaces which may be quickly and easily changed, so that a workman may select and use a working surface appropriate to a particular workpiece being held. The working surface is provided on a generally platelike interchangeable jaw member attached to the vise jaw without the need for permanent or semi-permanent fasteners which must be removed each time the jaw member is to be changed. With this invention, the workman may select the appropriate working surface from any of several found on a variety of different jaw members, and then easily change jaw members to install those with the proper working surface.

In accordance with the invention, the vise jaw is provided with a support block having means thereon for slidably receiving the interchangeable jaw member having thereon the working surface to hold the workpiece. The support block may be formed as an integral part of the jaw, or it may be semi-permanently or permanently attached to the jaw so that the removable jaw member will be properly positioned to hold the workpiece after engagement with the support block. Whether the support block is integral with the jaw or attached to the jaw, in a preferred embodiment the support block is provided with a pair of vertically extending ribs defining a pair of slots on the longitudinally opposed sides of the support block.

A pair of L-shaped locking arms extending from the longitudinally opposed sides of the removable jaw member are dimensioned to form a channel which fits over and slidably engages in locking reception the vertically extending ribs on the support block, with one leg of each L-shaped locking arm disposed within the corresponding slot of the support block. With this arrangement, the interchangeable jaw member may slide downwardly or upwardly on the pair of vertically extending ribs for installation or removal. The extent of downward travel of the removable jaw member on the support block is limited by mechanical contact between the support block and the removable jaw member, preferably against a longitudinally extending horizontal ledge of the support block upon which the removable jaw member rests in its furthest downward position.

It will be appreciated from the foregoing that the present invention represents an advance in the utilization of vises for gripping any of a variety of workpieces. With the interchangeable jaw member of the present invention, a workman may quickly change the jaw member upon which the working surface for holding the workpiece is located. After considering the shape and material of the workpiece, the workman may select an appropriate working surface from a variety of surfaces found on an available group of interchangeable jaw members, and then install the proper jaw member without significantly interrupting the flow of work. The workman is thereby encouraged to utilize the proper configuration, finish and material for the working surface, since the change of working surface may be performed readily.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate embodiments of the invention. In such drawings.

DETAILED DESCRIPTION OF THE PREFERRED EMBODIMENT

Figure 1:
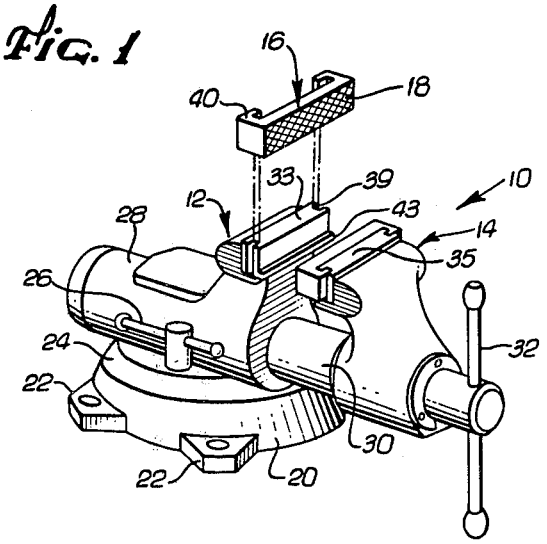
FIG. 1 is a perspective view of a vise, illustrating in partially exploded form jaw members embodying the novel features of this invention.
Figure 3:
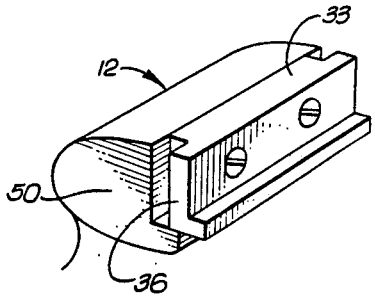
FIG. 3 is an enlarged perspective view of a vise jaw made in accordance with the invention, illustrating a support block whose sides are flush with the sides of the vise jaw.

As is shown in the drawings for purposes of illustration, the present invention is embodied in a vise 10 having a fixed jaw 12 and a movable jaw 14 with an interchangeable jaw member 16 for mounting on each jaw 12 and 14. The interchangeable jaw member 16 has a working surface 18 thereon for gripping and holding a workpiece (not shown) held between the jaws 12 and 14 of the vice 10.

The vise 10 is illustrated in FIG. 1 as a bench vise for attachment to a workbench (not shown), and includes a subbase 20 with bolt lugs 22 thereon through which the subbase 20 may be fastened to the workbench. An upper base 24 of the vise 10 is mounted for rotation on the subbase 20 and can be locked into position in a conventional manner by a rotation locking handle 26. Mounted to the upper base 24 is a support housing 28 for supporting the fixed jaw 12 and additionally containing a portion of a movement mechanism (not shown) by which the movable jaw 14 is moved relative to the fixed jaw 12. A support bar 30 mounts the movable jaw 14 to the support housing 28, and a handle 32 operates the movement mechanism for moving the movable jaw 14 towards the fixed jaw 12 in a facing relation thereto. Typically, the movement mechanism is a screw extending within the support bar 30 which turns against threads loaded on the interior of the movable jaw 14.

Figure 2:
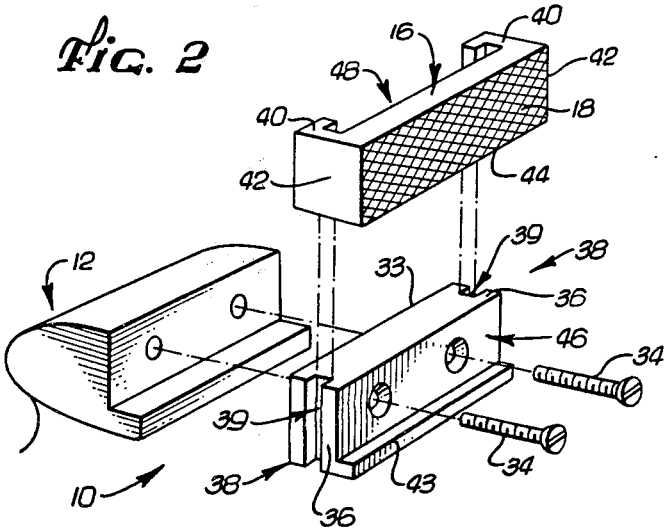
FIG. 2 is an enlarged, exploded perspective view of one jaw of the vise of FIG. 1.
Figure 4:
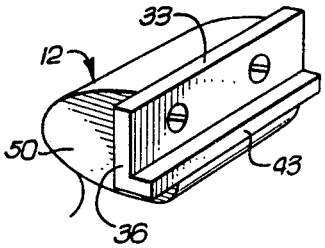
FIG. 4 is an enlarged perspective view of a vise jaw made in accordance with the invention, illustrating a support block whose sides protrude beyond the sides of the vise jaw.

In accordance with the present invention, and as shown for the fixed jaw 12 by way of example in FIG. 2, the jaw 12 is provided with a support block 33 for slidably receiving one of the interchangeable jaw members 16. The support block 33 is semi-permanently attached to the jaw 12 by a pair of screws 34 so that the support block on the fixed jaw 12 is disposed in a position facing and opposite to a similar jaw base 35 on the movable jaw 14.

The interchangeable jaw member 16 is a generally channel-shaped member having the working surface 18 thereon for holding the workpiece. As illustrated in FIGS. 1 and 2, the working surface 18 may be planar and have scoring therein to grip the workpiece more securely. Alternatively, the working surface may have one of many possible configurations, surface finishes or compositions, such as, for example, a smooth planar surface, an indented surface for holding shaped objects such as round rods, or a surface of plastic or rubber for holding easily scratched workpieces. The workman using the vise selects the proper working surface for a particular workpiece from a collection of interchangeable jaw members 16 available to him. The interchangeable jaw member approach of this invention allows the workman great flexibility in selecting the jaw member 16 appropriate for a particular job, since the jaw member 16 used on the fixed jaw 12 may be different than or the same as that used on the movable jaw 14.

The support block 33 and the interchangeable jaw member 16 are provided with engagement means for slidably engaging the support block 33 with the interchangeable jaw member 16. In the presently preferred embodiment, the support block 33 has a pair of vertically extending ribs 36, wherein one of the ribs is located on each of the longitudinally opposed sides 38 of the support block 33. The back of each rib 36 defines a slot 39 in the support block 33. The interchangeable jaw member 16 has a pair of generally L-shaped locking arms 40, one extending from each of the longitudinally opposed sides 42 of the jaw member 16 and dimensioned for slidable locking reception about the vertically extending rib 36, with one leg of the L-shaped portion disposed within the slot 39.

The interchangeable jaw member 16 is installed onto the support block 33 by placing the interchangeable jaw member 16 over the support block 33 with one leg of each L-shaped locking arm 40 disposed within the corresponding slot 39, so that the pair of locking arms 40 engages the pair of vertically extending ribs 36 in locking relation thereto, and sliding the interchangeable jaw member 16 downwardly. Placing the locking arms 40 at oppositely disposed sides of the jaw member 16 gives good lateral stability to the jaw member 16 when installed on the support block 33.

The extent of downward travel of the interchangeable jaw member 16 is limited by a longitudinally extending horizontal ledge 43 on the support block 33, so that the lower horizontal surface 44 of the interchangeable jaw member 16 rests against the horizontal ledge 43 when the interchangeable jaw member 16 is properly positioned oppositely from and facing the corresponding jaw member on the other jaw.

Although the interchangeable jaw member 16 is not permanently or semi-permanently fastened to the support block 33, proper support is provided so that the workpiece is firmly held by the working surface 18 with forces reacting through the jaws 12 and 14. With the interchangeable jaw member 16 installed on the support block 33, the compressive clamping forces between the jaws 12 and 14 are transmitted from a front vertical surface 46 of the support block 33 into the rear vertical surface 48 of the interchangeable jaw member 16 and thence to the working surface 18. Since the forces are compressive in nature, it is not necessary that the interchangeable jaw member 16 be rigidly attached to the support block 33, but only that the engagement means generally position the interchangeable jaw member 16 in the proper facing relation to the jaw member on the opposing jaw, and also to the workpiece. The vertically extending ribs 36 and cooperating locking arms 40 position the interchangeable jaw member 16 to hold the workpiece and to transmit the compressive forces, and also allow the interchangeable jaw member 16 to be installed and removed quickly from the support block 33. Preferably, the locking arms 40 are dimensioned to fit loosely within the slots 39 so that the jaw member 16 is not warped when loaded in compression through the working surface 18.

Figure 5:
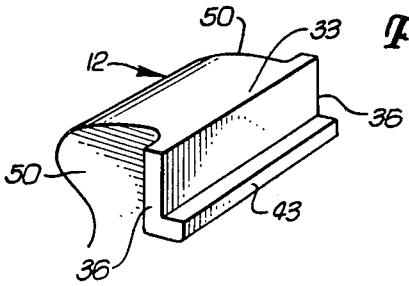
FIG. 5 is an enlarged perspective view of a vise jaw made in accordance with the invention, illustrating a support block formed integral with the jaw.

The support block 33 may be formed as an attachment to the jaw 12 or 14, as illustrated in FIGS. 1–4, or it may be formed integral with the jaws 12 or 14, as illustrated in FIG. 5. Although it is not intended that the attached support block 33 illustrated in FIGS. 1–4 be changed each time the interchangeable jaw member 16 is changed, it is within the scope of the invention to provide a variety of support blocks 33 for specialized clamping requirements, such as oversized workpieces which require working surfaces 18 extending well beyond the vicinity of the jaws 12 and 14. For example, the vertically extending ribs 36 form one side of a U-shaped channel on the longitudinally opposed sides 38 in the embodiment illustrated in FIG. 2, while the vertically extending ribs 36 in the embodiment of FIG. 3 form half a channel with the longitudinally opposed sides 38 flush with a side 50 of the jaw 12. In yet another embodiment illustrated in FIG. 4, the vertically extending ribs 36 form an extension of the support block 33 which projects longitudinally outwardly from the side 50 to provide a relatively longer horizontal ledge 43. Support blocks as described and sets of removable jaw members may be produced as sets for use as workpiece holding attachments on preexisting vises having provision on the jaw for attachment of the jaw bases. Still further, the support block may be formed integrally with the jaw 12 or 14 as by casting or machining the jaw to include the required ribs 36 projecting outwardly from the sides 50 of the jaw in combination with the horizontal ledge 43, as illustrated with respect to the fixed jaw 12 in FIG. 5.

It will now be appreciated that, through the use of this invention, a workman may easily interchange the jaw members 16 on the jaws 12 and 14 of a vise 10, so that the working surface 18 appropriate to a specific job may be quickly installed on the vise 10. In the ordinary course of changing a jaw member 16 made in accordance with the invention, it is not necessary that the operator loosen, remove, install, or tighten any fasteners, thereby allowing the installation of the jaw member 16 to proceed without significantly interrupting the normal course of the work.

Although a particular embodiment of the invention is described in detail for purposes of illustration, various embodiments may be made without departing from the spirit and scope of the invention. Accordingly, the invention is not to be limited except as by the appended claims.

I claim:

1. A vise for holding a workpiece in compression, comprising:

a vise body, said body including a base, a support housing mounted on said base, a fixed jaw on said support housing, a movable jaw, and a mechanism for moving said movable jaw in facing relation to said fixed jaw;

a pair of support blocks, one on said fixed jaw and one on said movable jaw, each of said support blocks having a pair of vertically extending ribs on the longitudinally opposed sides thereof and a longitudinally extending horizontal ledge thereon, and having a generally flat front vertical surface extending between said pair of ribs, said ribs defining a corresponding pair of laterally outwardly open and vertically oriented slots disposed in positions spaced rearwardly from said front vertical surface by the thickness of said ribs; and a pair of interchangeable jaw members, each of said interchangeable jaw members having a front working surface and a generally flat rear vertical surface, and a pair of generally L-shaped locking arms at longitudinally opposed sides of said rear vertical surface, said locking arms each having a first leg portion extending generally rearwardly from said rear vertical surface for a distance greater than the thickness of said ribs on said support blocks and a second leg portion extending generally laterally inwardly and having a size and shape relative to the size and shape of said slots on said support block for loose fitting locking reception of said locking arms of each of said jaw members with respect to said pair of vertically extending ribs on one of said support blocks, so that each of said interchangeable jaw members may be engaged to one of said support blocks to fit loosely thereon and moved downwardly by sliding until the sliding is stoppped by contact of said interchangeable jaw member with said longitudinally extending horizontal ledge, whereby said front vertical surface of said support block and said rear vertical surface of said jaw member are placed in a facing abutting relation when said front vertical surface of said jaw member is subjected to a rearwardly directed compressive force.

2. The vise of claim 1 wherein each of said support blocks is integral with a respective jaw of said vise.

3. The vise of claim 1 wherein at least one of said support blocks is removably attached to a jaw of said vise.

4. For use with a vise for holding a workpiece in compression, said vise having a vise body, the body including a base, a support housing mounted on the base, a fixed jaw on the support housing, a movable jaw, and a mechanism for moving the movable jaw in facing relation to the fixed jaw, a workpiece holding attachment comprising:

a pair of support blocks one on the fixed jaw and one on the movable jaw, each of said support blocks having a pair of vertically extending ribs on the longitudinally opposed sides thereof and a longitudinally extending horizontal ledge thereon, and further having a generally flat front vertical surface extending between said pair of ribs, said ribs defining a corresponding pair of laterally outwardly open and vertically oriented slots disposed in positions spaced rearwardly from said front vertical surface by the thickness of said ribs; and a pair of interchangeable jaw members, each of said jaw members having a front working surface and a generally flat rear vertical surface, and a pair of generally L-shaped locking arms at longitudinally opposed sides of said rear vertical surface, said locking arms each having a first leg portion extending generally rearwardly from said rear vertical surface for a distance greater than the thickness of said ribs on said support blocks and a second leg portion extending generally laterally inwardly and having a size and shape relative to the size and shape of said slots on said support block for loose fitting locking reception of said locking arms of each of said jaw members with respect to said pair of vertically extending ribs on one of said support blocks, so that each of said interchangeable jaw members may be engaged to one of said support blocks to fit loosely thereon and moved downwardly by sliding until the sliding is stopped by contact of said interchangeable jaw member with said longitudinally extending horizontal ledge, whereby said front vertical surface of said support block and said rear vertical surface of said jaw member are placed in a facing abutting relation when said front vertical surface of said jaw member is subjected to a rearwardly directed compressive force.

5. The holding attachment of claim 4 wherein at least one of said support blocks is removably attached to a jaw of said vise.

6. For use with a vise having jaws for holding a workpiece in compression, wherein at least one jaw has a support block thereon, said support block having a generally flat front vertical surface extending between a pair of vertically extending ribs at longitudinally opposing sides thereof defining a pair of laterally outwardly open vertical slots disposed in positions spaced rearwardly from said front surface by the thickness of the ribs, and a longitudinally extending horizontal ledge along the lower end of the front surface, an interchangeable jaw member, comprising:

a plate having a front working surface thereon and a generally flat rear vertical surface, said plate further having a pair of generally L-shaped locking arms at longitudinally opposing ends of said rear surface, said locking arms each having a first leg portion extending generally rearwardly from said rear vertical surface for a distance greater than the thickness of the ribs on the support block and a second leg portion extending generally laterally inwardly and having a size and shape relative to the slots on the support block for loose fitting locking reception of said arms into the slots defined by the vertically extending ribs, whereby the plate may be loosely engaged over the ribs and slid downwardly until the downward movement is stopped by contact against the horizontal ledge with the rear surface of said plate disposed for facing abutting relation with the front surface of the support block when said front working surface is subjected to a rearwardly directed compressive force.

* * * * *